United States Patent [19]

Brauer

[11] 4,305,692

[45] Dec. 15, 1981

[54] MOLD HANDLER

[76] Inventor: Edwin H. Brauer, 3876 Silsby Rd., Cleveland, Ohio 44114

[21] Appl. No.: 769,511

[22] Filed: Feb. 17, 1977

Related U.S. Application Data

[62] Division of Ser. No. 589,678, Jun. 24, 1975, abandoned.

[51] Int. Cl.[3] ..... B65G 7/00

[52] U.S. Cl. ..... 414/786; 164/137; 164/168; 164/183; 164/339; 164/409; 294/86 R; 294/88; 294/67 BB; 414/763; 414/783

[58] Field of Search ..... 164/409, 137, 339, 168, 164/183, 364; 294/86 R, 88, 67 BB; 414/786, 757, 763, 783

[56] References Cited

U.S. PATENT DOCUMENTS

| | | | |
|---|---|---|---|
| 1,343,335 | 6/1920 | Prince | 214/1 R |
| 1,807,360 | 5/1931 | Wehr | 214/650 R X |
| 2,390,293 | 12/1945 | Colson | 294/86 R |
| 3,002,779 | 10/1961 | Frate et al. | 294/86 R X |
| 3,068,537 | 12/1962 | Fellows | 164/168 |
| 3,438,510 | 4/1969 | Fawell | 294/86 R X |
| 3,508,676 | 4/1970 | Peterson | 214/147 G X |
| 3,878,881 | 4/1975 | Lund et al. | 164/137 X |

FOREIGN PATENT DOCUMENTS

| | | | |
|---|---|---|---|
| 1930824 | 1/1970 | Fed. Rep. of Germany | 294/88 |
| 1397325 | 3/1965 | France | 294/88 |

*Primary Examiner*—Frank E. Werner
*Attorney, Agent, or Firm*—John H. Mulholland

[57] ABSTRACT

A mold handler for flaskless foundry molds made up basically of a horizontal support beam and two clamping arms supported for movement along the beam toward and away from each other. Each clamping arm has rotationally mounted pads with gripping surfaces having serrations thereon. The pads are self-aligning. The clamping arms move via a fluid circuit operably connected thereto. The entire structure is suspended by apparatus lying substantially within a plane containing the center of gravity of the beam and the structure it supports. The clamping arms are maintained at equal and opposite distances from the center of gravity at all times during operation of the mold handler by means of an interconnecting synchronizing linage. The fluid circuit controls and actuates fluid cylinders to urge the clamping arms toward and away from one another selectively to engage and release the gripping surfaces with and from a flaskless mold positioned therebetween.

2 Claims, 8 Drawing Figures

MOLD HANDLER

This is a division of application Ser. No. 589,678, filed June 24, 1975, now abandoned.

BACKGROUND OF THE INVENTION

This invention relates to a mold handler for the foundry industry. In recent years no-bake molding processes have been developed in which sand molds can be made of sufficient strength that even without baking they do not require flasks. These flaskless no-bake molds are made from sand which is bonded together by organic chemical catalyst and binder combinations which result in molds with both desirable gas permeability and high strength. Prior to these developments, sand molds either had to be baked to give them sufficient bonded strength to retain their dimensional and structural integrity during mold handling, closing and pouring or the molds had to be made in mold flasks generally provided with trunnions so that they could be adequately supported and "rolled over", and supplied with jackets or support frames during pouring.

As will be apparent to those familiar with the foundry industry, molds for the production of metal castings are typically made in two parts with the bottom part being termed a "cope" and the top part being termed a "drag". The mold sand typically is packed around a pattern in a pattern box to make the cope and around a different pattern in a pattern box to make the drag. Accordingly, to close the mold the cope is drawn from its pattern box and the drag is drawn from its pattern box and the cope and the drag brought together in the "mold closing" operation. As will be well appreciated to those familiar with the foundry art, the removal of the mold parts from their respective pattern boxes is facilitated by providing the box and therefor the mold sides with a draft angle. The draft angle of the mold sides is usually of from 0–5 degrees from the perpendicular with the bottom or top of the mold part. Thus, any mechanical gripping of the mold part is not done against opposed parallel sides thereof but rather by gripping converging sides.

During the mold closing operation, the cope is set with its cavity open upwardly and the drag is brought to the cope with its cavity facing downwardly so that the two parts are assembled in register one over the other, and generally in a telescoping manner, to make a fully enclosed cavity which becomes the shape of the casting left after molten metal is poured into it, solidified and then removed from the mold, as by means of a "shake-out". During the time the molten cast metal is solidifying within the mold, gasses escape through the sand mold and it is for this reason that it is important to provide mold permeability. Until the heretofor mentioned developments in no-bake mold compositions, it had been a problem to obtain a proper combination of permeability and strength which did not require a flask. With the new technology which has been developed permitting chemically bonded no-bake molds, a problem of mold handling has been encountered. With no trunnioned flasks with which to handle the molds, and since molds do not have parallel opposing mold part sides, mechanical handling of the molds in a manner which did not damage them and render them useless has been a problem.

The no-bake mold handler of the instant invention has reduced the manpower required and increased production by firmly gripping the converging sides of flaskless no-bake mold parts with serrated gripper pads which are completely self-aligning and mounted on anti-friction spindles for ease in rolling over the mold parts for assembly. The self-aligning gripping pads easily and automatically adjust to any typical draft angle of mold part sides and the fluid cylinder operated gripping arms automatically adjust for any mold size. In one embodiment of the invention, the roll-over motion can be supplied with a motor drive which allows the operator to "jog" the mold angular position. Thus, it will be seen that the invention involves a no-bake mold handler which can be used to safely and efficiently pick up, move, roll over and close flaskless no-bake foundry molds.

BRIEF DESCRIPTION OF THE INVENTION

The invention involves a mold handler for flaskless foundry molds made up basically of a horizontal support beam and two clamping arms supported on carriages supporting pairs of wheels for movement along the beam toward and away from each other. The beam is an "I" beam and one wheel of each of the pairs runs on opposite sides of the vertically oriented central web of the "I" beam. The clamping arms are suspended from the carriages or from outwardly extending portions of the axles of the wheels. The clamping arms move over a range of distances along the "I" beam by means of a fluid cylinder and fluid circuit operably connected thereto. The entire structure is suspended by means such as a lifting eye lying substantially within a plane containing the center of gravity of the "I" beam and the structure it supports. The clamping arms are maintained at equal and opposite distances from the center of gravity at all times during operation of the mold handler by means of either a horizontal or a vertical synchronizing interconnecting linkage connecting the carriages. The clamping arms each have, adjacent an end thereof, a self-aligning pad rotationally mounted on a spindle in face to face engagement with a pad of the other arm. These pads include gripping surfaces having serrations thereon and are self-aligning for accomodating mold draft angles in that they can move by means of a socket connection in a range of angles out of perpendicular with the axis of the spindle on which they are rotationally mounted. The fluid circuit which controls and actuates the fluid cylinder includes a detented valve having one position in which the fluid circuit constantly supplies pressurized fluid to the cylinder to urge the clamping arms toward each other and to maintain them in clamping engagement with a mold therebetween. A second position of the detented valve is provided in which the fluid circuit is permitted selectively to provide pressurized fluid to the fluid cylinder to release the clamping engagement and urge the clamping arms away from each other. The fluid circuit also includes at least one and, for safety, generally in the preferred embodiment, two unclamp valves having a first position in which the fluid circuit is permitted to selectively urge the clamping arms toward each other and a second position in which the pressurized fluid is supplied to the fluid cylinder so that the gripping arms are urged away from each other. These unclamp valves are capable of rapid selective operation from the first position to the second position to intermittently and selectively move the gripping arms from a clamped position to an open position by "jogging". In the preferred embodiment, the mold is manually rolled over on the spindles but as an option, the roll-over motion can be supplied with a motor drive. This feature allows the operator to "jog" the mold angular position. The operation of the fluid circuit is controlled from push buttons, preferably mounted on one of the gripper arms or remotely associated by means of a separately connected remote manual control unit.

DETAILED DESCRIPTION OF THE EMBODIMENT OF THE INVENTION

Figure 1:
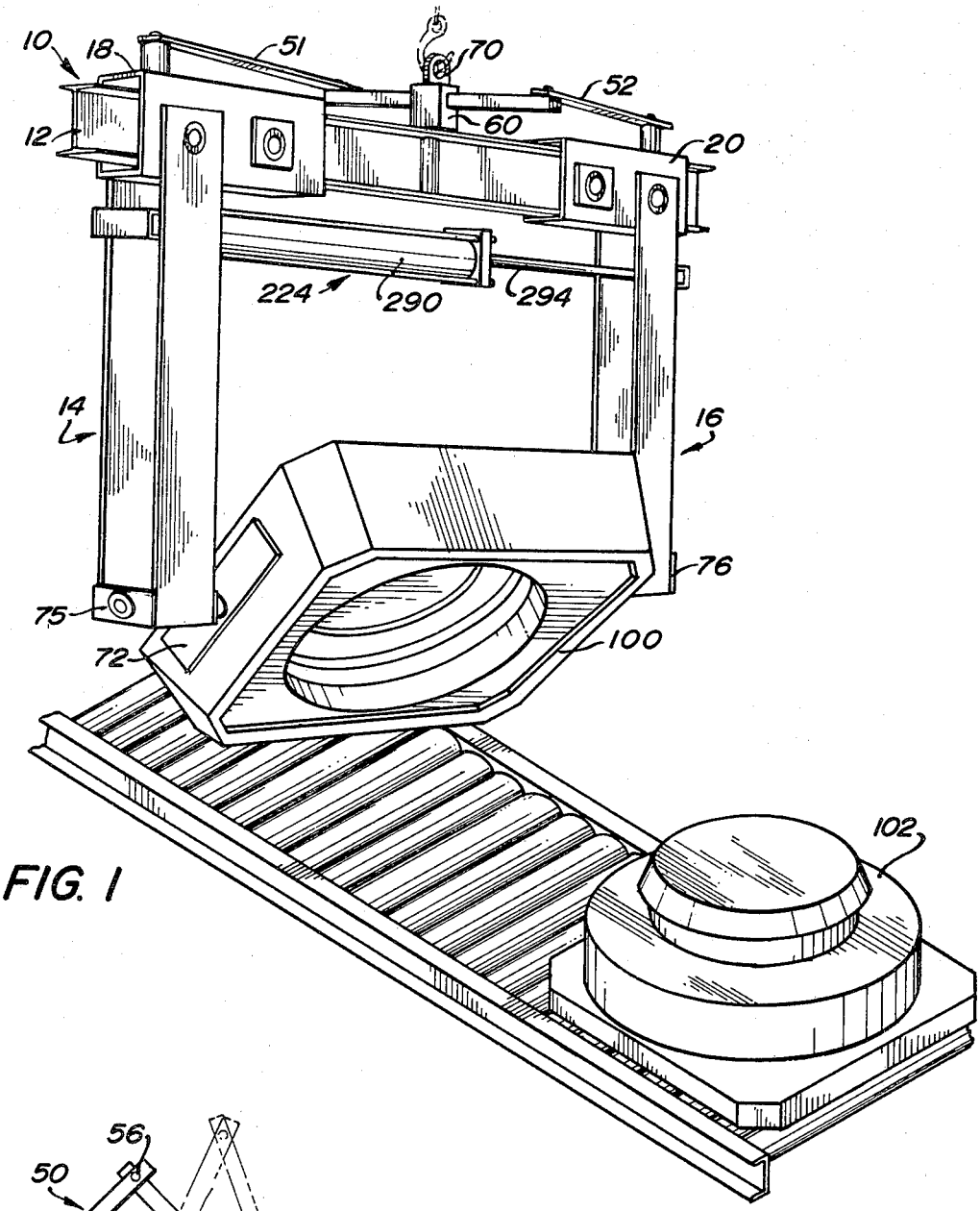
FIG. 1 is a perspective view of the mold handler constructed according to the principles of this invention showing a mold being advanced toward a mold closing operation.

In the embodiment illustrated, the numeral 10 generally designates a mold handler constructed according to the principles of this invention.

The mold handler 10 includes an "I" beam 12 and left and right gripping arms generally designated 14 and 16, respectively. The gripping arms 14 and 16 suspend from boxlike carriage member 18 and 20, respectively. The carriage members 18 and 20 are telescoped over the ends of "I" beam 12 for movement toward and away from each other along the "I" beam. Vertically upstanding central web member 22, lower flanges 24 and upper flanges 26 define beam 12. Pairs of wheels 28 and 30 ride on the top surface of flanges 24 on either side of central web 22 and support the carriages 18 and 20 by rotation about their axes for movement toward and away from each other. Each of the carriages 18 and 20 have two pairs of wheels 28 and 30 riding along the top of lower flanges 24.

Figure 3:
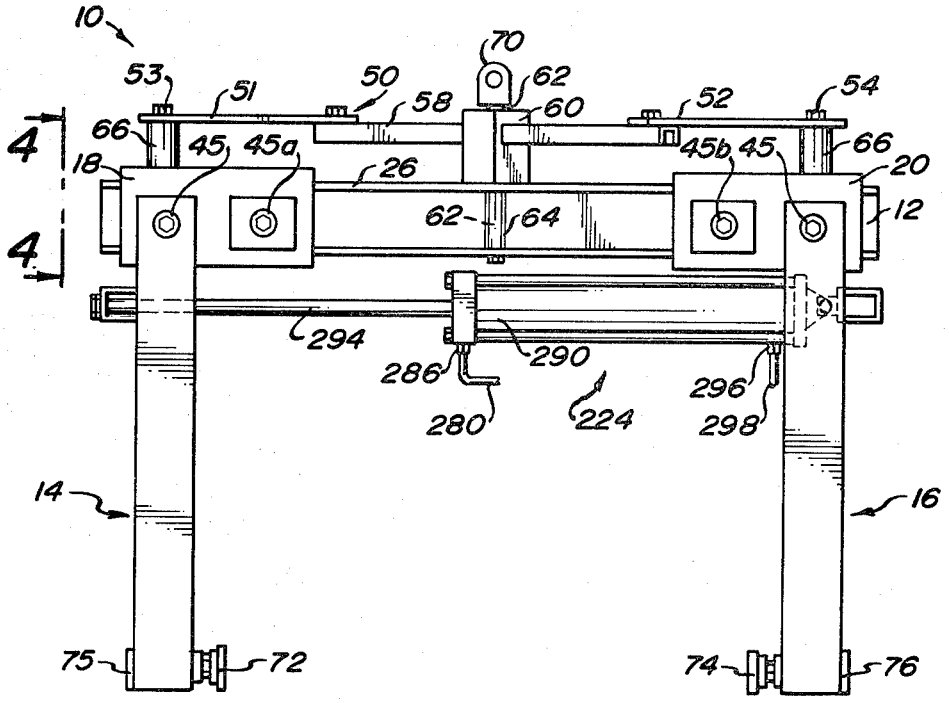
FIG. 3 is a side elevational view of the mold handler of this invention.
Figure 4:
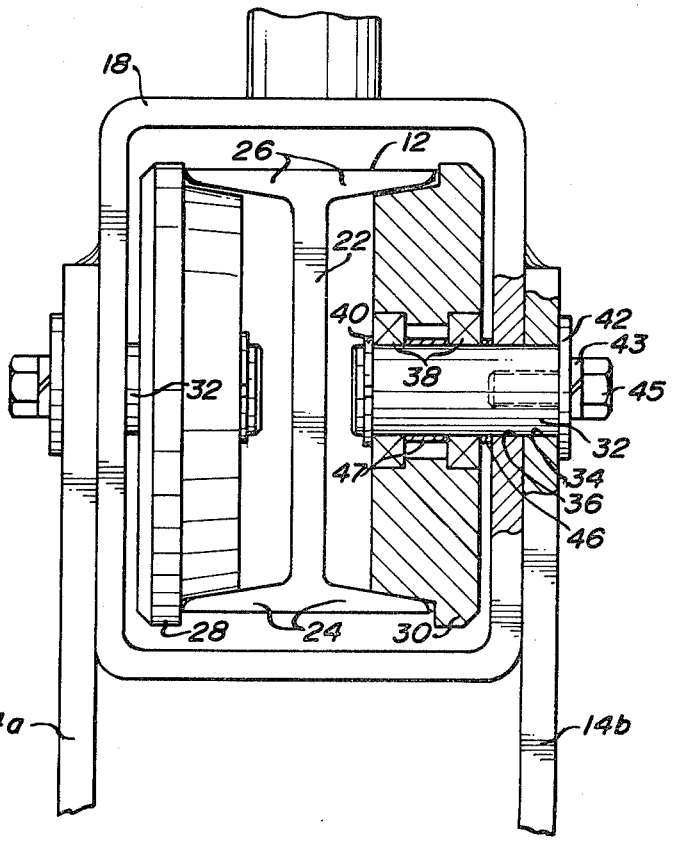
FIG. 4 is a fragmentary end elevational view of the mold handler of this invention taken along the lines 4—4 of FIG. 3.

In the illustrated embodiment, vertical members 14*a* and 14*b* are attached, as by welding, to the side of carriage 18. Axle shafts 32 are located within openings 34 of the legs 14*a* and 14*b* of clamping arm 14, as perhaps best seen in FIG. 4. In like manner, the axle shafts 32 pass through openings 36 in the walls of carriage 18. The wheels 28 and 30 have bearings 38 for running on shafts 32 and the wheels are maintained on the shafts by means of split retaining rings 40. The arms 14*a* and 14*b* are preferably welded to the outer walls of carriage 18 and a spacing washer 42, lock washer 43, together with a bolt 45, by means of its threaded cavity in the outer end of shaft 32, retain the wheel and shaft assembly in proper relationship to the clamping arm structure. Appropriate spacers 46 and 47 retain bearings 38 in their correct axial position in a manner which will be readily understood by those skilled in the art. Each of the carriages 18 and 20, in addition to the wheels 28 and 30 shown in FIG. 4, have an inwardly located pair of wheels about an axis represented by bolts 45*a* and 45*b*, respectively, in FIG. 3. The pairs of wheels associated about the axes 45*a* and 45*b* are mounted in the same manner as wheels 28 and 30 of carriages 18 and 20.

Figure 2:
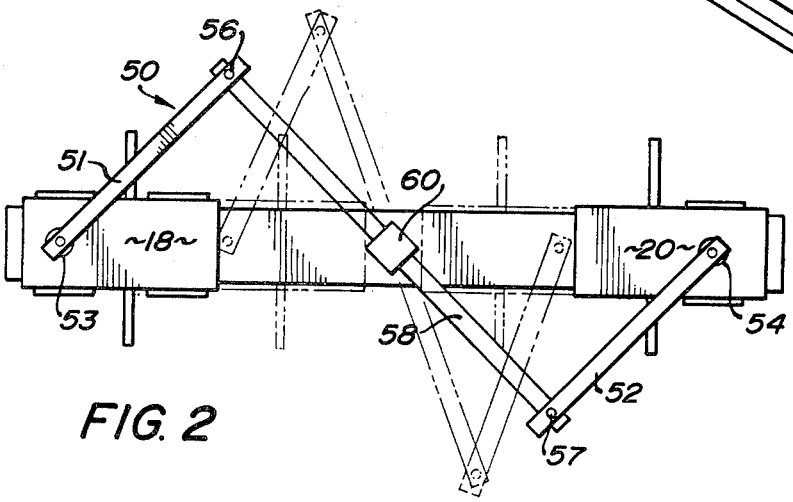
FIG. 2 is a partial top plan view of the mold handler of this invention showing different positions of the clamping arms synchronizing linkage in full and in phantom.

Carriages 18 and 20 have a linkage generally designated by the numeral 50 which synchronizes their movement toward and away from each other and keeps them equidistant from the approximate plane containing the center of gravity of the mold handler and the structure it supports. The linkage 50 is perhaps best illustrated in FIGS. 2 and 3 wherein outer links 51 and 52 are pivotally connected by means of pivot pins 53 and 54 to carriages 18 and 20, respectively. On the opposite end of the outer links 51 and 52 are pivot pins 56 and 57. Pins 56 and 57 connect the links 51 and 52 to a common central link 58 which is pivoted about its center by means of a pivoted housing 60. The pivoted housing 60 rides on a central stub shaft 62 which is seated and retained in a cylindrical housing 64 extending through the top flange 26 of the "I" beam 12 and into the central web 22. The pivoted housing 60 spaces link 58 from the beam 12. In the same manner, outer or end links 51 and 52 are spaced from the carriages 18 and 20 by spacers 66 which also provide the openings in which pins 53 and 54 pivot. A lifting eye 70 is provided at the upper end of the stub shaft 62 at the top of pivoted housing 60 and the entire mold handler is suspended from this lifting eye by means of a crane or other appropriate lifting mechanism.

It is important to notice in this regard that the lifting eye 70 is in the approximate plane of the center of gravity of the mold handler and the structure it supports. Accordingly, since the clamping arms 14 and 16 move equal and opposite distances from this plane, the mold handler does not tilt in one direction more than in another even though it may be suspended only by means of a crane hook through the lifting eye 70.

Figure 5:
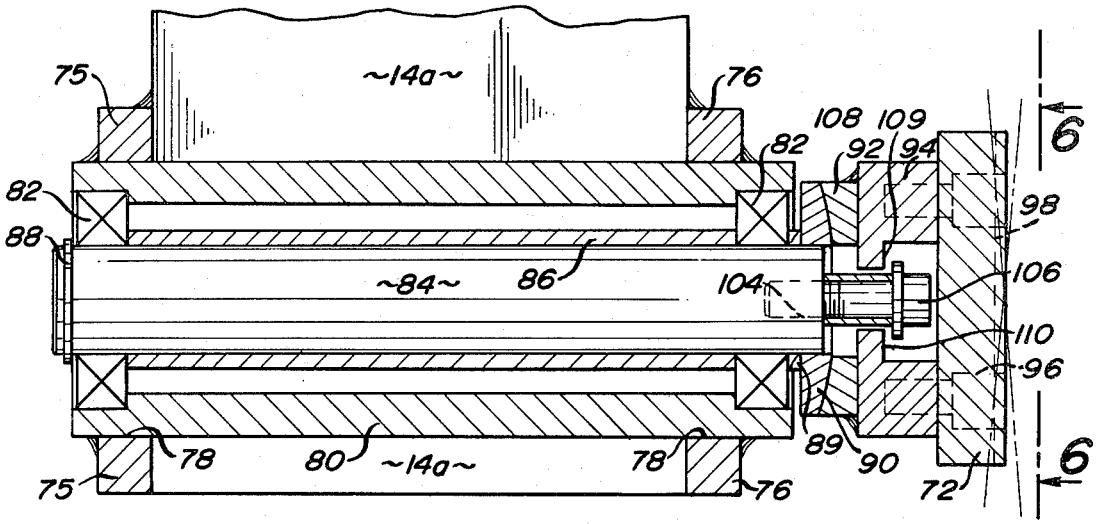
FIG. 5 is a cross sectional elevational view of the gripping pad and mounting therefor adjacent the end of the left gripping arm of the mold handler of FIG. 3.
Figure 6:
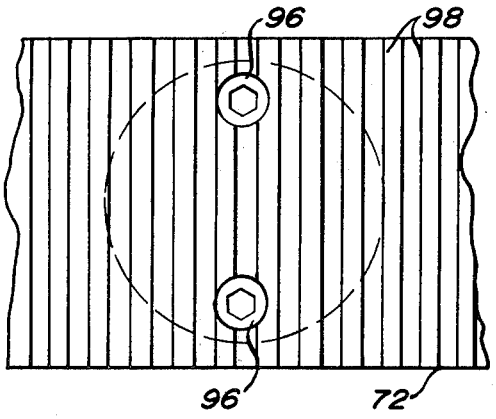
FIG. 6 is an end elevational view of the gripping pad of FIG. 5 taken along the lines 6—6 of FIG. 5.

At the ends of the clamping arms 14 and 16 are self-aligning serrated pads 72 and 74. FIGS. 5 and 6 show the details of the mounting of pad 72 on clamping arm 14. Pad 74 is similarly mounted on arm 16. Two rectangular plate members 75 and 76 are welded so as to span between vertical members 14*a* and 14*b* of clamping arm 14. Mounted in openings 78 in plates 75 and 76, is a sleeve 80. Sleeve 80 has bearings 82 mounted at either end thereof in which a spindle or shaft 84 is journalled. A spacer 86 maintains the bearings 82 in proper axial relation. A retainer ring 88 prevents the spindle 84 from being axially removed from the bearings 82. Adjacent the end of the spindle 84 opposite retaining ring 88 and welded thereto, is a spacer 89 having a convex annular seat 90. The convex surface of the member 90 fits into a concave socket member 92 welded to an annular hub 94. The hub 94 has a serrated pad 72 mounted thereon by means of bolts 96. Because of the mating convex surface of the element 90 welded and rigidly held on the end of spindle 84 and the concave surface 92 welded and held rigid on the hub 94, a movement of the pads in a range of angles from the perpendicular with the axis of spindle 84 can be obtained such that the serrated pad surface with serrations 98 can move to an angle of from 0–5 degrees from the perpendicular with said axis for self-aligning engagement, with the converging or tapered walls of a mold part such as a cope 100 and drag 102 illustrated in FIG. 1.

On the end of spindle 84 is a threaded cavity 104 into which a cap screw 106 with a flanged head is threaded. An annular spacer 108 guarantees that the cap 106 remains spaced from the inner surface 109 of flange 110 of the hub 94 in such a manner that it prevents the hub 94 and pad 72 from falling off of the end of the spindle assembly but it permits the concave socket of element 92 to engage the convex surface of element 90 when the clamping arms are brought together in clamping engagement against a mold part.

Figure 7:
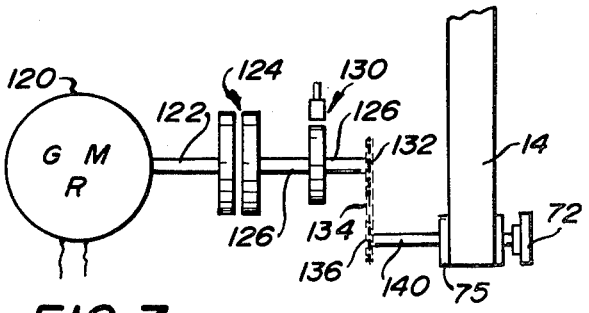
FIG. 7 is a schematic view of the optional motor and drive mechanism for powering the mold roll-over motion.

FIG. 7 schematically illustrates an optional drive for powering the roll-over motion of spindle 84 and pad 72. A gear reduction motor 120 is provided with an output shaft 122 which goes to a clutch 124. When engaged, the clutch 124 drives shaft 126. Shaft 126 includes a schematically illustrated, selectively operated brake means 130. On the end of the shaft 126 beyond the brake 130 is illustrated a chain sprocket 132. The chain sprocket 132 is connected by means of driving chain 134 to a sprocket 136 on extension 140 of spindle 84 on the end of clamping arm 14. Spindle extension 140, when rotated, can drive the pad 72 throughout 360 degrees to power the roll-over motion of the mold. Thus, it will be seen when heavy molds are desired to be mechanically "jogged" during the mold closing operation, the appropriate controls can be provided to run the gear reduction motor 120. Accordingly, by means of clutch 124 and brake means 130 controlling the drive through chain 134 to spindle extension 140, a controlled rotational motion of the mold port can be accomplished. It will be readily apparent that either one or both of the gripping pads 72 and 74 can be driven, but if both are driven it would be necessary to synchronize the driving unit. Furthermore, it is contemplated that alternative means of driving the roll-over motion can be provided and that the schematic drawing of FIG. 7 is merely to illustrate to those skilled in the art one manner of accomplishing this end.

The mold handler of the present invention includes a control circuit 200 to control the movement of the gripping arms 14 and 16 to grip a mold part 100 and maintain a constant pressure between the gripping arms 14 and 16 and the mold part 100 when the arms are in a gripping position. The circuit 200 also controls the movement of the gripping arms 14 and 16 to release the mold part 100 from being retained between the gripping arms. The control circuit 200 provides for "jogging" the gripping arms from a gripping position to a released position so that the mold is no longer retained therebetween.

Figure 8:
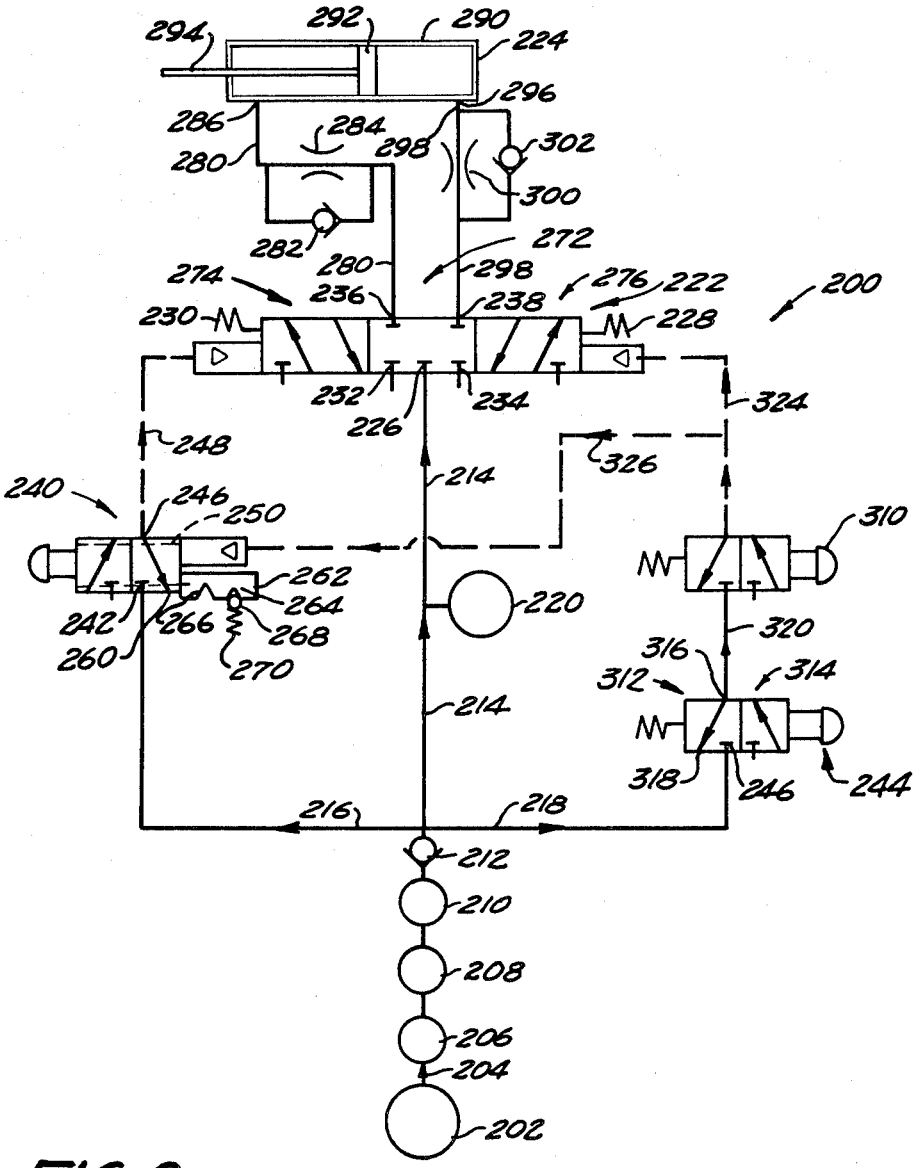
FIG. 8 is a schematic diagram of the fluid circuit which controls the operation of the clamping arm fluid cylinder.

It should be understood that the control circuit 200, shown in FIG. 8, is a pneumatic system but that other fluid control circuit devices may be provided. Since compressed air is clean, the use of a pneumatic circuit is provided in the described embodiment. Therefore, if there is any leakage in the circuit 200, the mold will not be contaminated. A hydraulic circuit can, of course, also be used.

The control circuit 200 of the present invention includes an air supply 202 of any conventional design, which supplies compressed air to the other components of the circuit. The compressed air provided by the air supply 202 flows through conduit 204 and subsequently through a filter 206, a regulator 208, and a lubricator 210. The filter 206, filters out any impurities in the air. The regulator 208 regulates the pressure of the compressed air so that the compressed air is supplied to the other components of the control circuit 200 at a uniform pressure. The lubricator 210 is provided to lubricate the compressed air flowing through the other components of the circuit 200 to decrease the wear of those other components as will be hereinafter described. Therefore, the filter 206, the regulator 208 and the lubricator 210 provide clean, lubricated air at a controlled pressure to the other components of the control circuit 200 described hereinafter.

As the compressed air leaves the lubricator 210, it passes through a check valve, schematically indicated at 212. The check valve 212 is of any conventional design which allows pressurized air to flow to the other components of the circuit 200 by means of the conduits 214, 216 and 218 but the check valve 212 does not allow any compressed air to flow in a reverse direction as will be hereinafter described.

An accumulator 220 is connected to conduit 214 to minimize any variations or fluctuations in the pressure of the air flowing through conduit 214 and maintain pressure in the conduit 214 when the air supply 202 is disconnected or, is inadvertently broken or ruptured. The compressed air flows through conduit 214 to a spring centered, three-positioned valve, generally indicated at 222. The valve 222 is provided to control the flow of compressed air into the pneumatic motor 224 to thereby control the movement of the motor 224 as will be hereinafter described. The conduit 214 terminates at port 226 of the three-positioned, spring centered valve 222.

The spring centered three-positioned valve 222 is shown in FIG. 8 in a neutral or centered position. In the neutral position, the springs 228 and 230 retain the valve 222 in the neutral centered position until a compressed air signal is provided to the valve 222, as will hereinafter be described. In the neutral position, ports 232 and 234 are not connected to any source of compressed air or any other ports. Ports 232 and 234 are exhaust ports so that any compressed air supplied thereto is exhausted to the atmosphere. The port 226, to which compressed air is supplied, is blocked so that compressed air does not flow from that port. Also in the neutral position, ports 236 and 238 which are connected to the pneumatic motor 224 as will hereinafter be described are blocked and no compressed air is supplied thereto. Therefore, when the valve 222 is in a neutral position, the motor 224 will not be moved. In fact, the motor 224 will be locked in its position so long as no air escapes from the conduits and components inter-connecting the motor 224 and ports 236 and 238.

The compressed air flowing through conduit 216 is supplied to the detented clamp valve, generally indicated at 240 and terminates at port 242 of the valve 240. The compressed air flowing through conduit 218 is supplied to the first spring biased unclamp valve 244 and terminates at port 246 of the valve 244.

Thus, as can be seen from the above, when compressed air is supplied to the components of the circuit 200 from the compressed air supply 202, each of the conduits 214, 216 and 218 terminate at ports which do not allow any further flow of the compressed air therethrough.

When the operator of the mold handler desires to move the gripping arms 14 and 16 toward each other to grip a mold port 100 therebetween, he will depress the detented clamp valve 240. Port 246 of valve 240 is connected to port 242 and the compressed air supplied to port 242 through conduit 216 is allowed to flow through conduit 248 to the spring centered, three-position valve 222. This compressed air signal activates valve 222 to supply compressed air to the motor 224 as will be hereinafter described.

The detented clamp valve 240 is of any conventional design and has a movable spool indicated at 250, which moves between a neutral or second position in which the port 242 is blocked and the port 246 is connected to the atmosphere through port 260, and a clamping or first position in which port 242 is connected to port 246 and allows compressed air to flow from the conduit 216 to the conduit 248 as hereinabove described. The movable spool 250 has attached thereto a detent bar 262 which has an indentation 264, which co-acts with the spring biased ball 268 when the spool is in the clamping position. The ball 268 is biased by spring 270 toward the detent bar 262 to retain the valve spool 250 in either one of the clamping or neutral positions as is known to those skilled in the art. Thus, when the spool 250 is moved to the clamping position, it is retained in that position by the spring biased ball 268 and detent bar 262 until it is moved out of that position and thus compressed air is constantly supplied to valve 222 through conduit 248 as hereinabove described.

The valve 222 is a spring centered, three-positioned valve of any well known construction and has three positions, a neutral position 272 which is described hereinabove, a clamping position generally indicated at 274, and an unclamping position 276, each of which will be hereinafter described.

When compressed air is supplied through conduit 248 to the valve 222, a force is exerted on the spool of the valve 222 so that the force exerted by the springs 228 and 230, tending to hold the valve 222 in the neutral position 272, is overcome and the valve spool is moved to the clamping position 274.

In the clamping position 274, compressed air is supplied to the motor 224 to move the gripping arms 14 and 16 toward each other. In the clamping position 274, port 226 of valve 222 is connected to port 236 so that compressed air is supplied to port 236 and subsequently flows through conduit 280, as shown in FIG. 8. A check valve 282 and a throttling valve 284 are provided in parallel in the conduit 280. The check valve 282 allows the free flow of compressed air through the conduit 280 in a direction towards the motor 224 and prohibits the flow of air from the motor 224 towards valve 222. The throttling valve 284 restricts and controls the flow of compressed air in either direction through conduit 280. Thus, when compressed air is supplied through conduit 280 to the motor 224, its flow is unrestricted through check valve 282 and enters the motor through port 286.

The motor 224 may be of any conventional design. The particular pneumatic motor 224 shown in the preferred embodiment is a conventional piston-cylinder design in which a cylinder 290 is provided with a piston 292 movable along the cylinder 290. A rod 294 is connected to the piston 292.

When compressed air is supplied to the port 286, the piston 292 and consequently the rod 294 is moved away from the port 286 and towards the port 296 of motor 224 and thereby relative movement of the cylinder 290 and rod is created.

To allow the air between the piston 292 and the port 296 to escape, the conduit 298 is provided and inter-connects port 296 on the cylinder 290 to port 238 of the valve 222. When the valve 222 is in the clamping position 274, the port 238 is connected to the exhaust port 234 and the air is allowed to be exhausted to the atmosphere.

To control the rate of movement of the motor 224, a throttling valve 300 is provided in the conduit 298 in parallel with a check valve 302 in a similar manner as provided in the conduit 280. The throttling valve 300 controls the rate of flow of the air escaping from the motor 224 into the atmosphere and thereby controls the rate of the speed of the motor 224. The check valve 302 prohibits the free and unrestricted movement of air from the motor 224.

Thus, when the valve 222 is in the clamping position 274 the pneumatic motor 224 moves in a clamping direction at a controlled and uniform speed. Once the mold part 100 is gripped between the gripping arms 14 and 16 it is retained therebetween by the constant pressure forcing the gripping arms together created by the motor 224.

It should be recognized that since the clamp valve 240 is detented as described above, compressed air will continue to be supplied to the motor 224, as long as it is in a clamping position. Even if the supply of compressed air 202 is disconnected, the check valve 212 will not allow compressed air to exhaust through the conduit 204 and the accumulator 220 will maintain a supply of compressed air to the motor 224. Thus, when the air supply 202 is disconnected while the mold part 100 is being transported, the gripping arms 14 and 16 will continue to grip the mold.

When the operator desires to release the gripping arms 14 and 16 so that the mold part 100 is no longer retained therebetween, he must move both of the unclamping valves 244 and 310 from a neutral or first position to an unclamping or second position, as will hereinafter be described. Both of the unclamping valves 244 and 310 are of the same construction and for purposes of simplicity only one of the unclamping valves will be hereinafter described. It should be understood though that the circuit 200 includes two unclamping valves 244 and 310 as a safety measure, so that by accidentally depressing one of the unclamping valves 244, 310, the mold part 100 will not be released and perhaps damaged.

The unclamping valve 244 has a neutral position, generally indicated at 312, and an unclamping position, generally indicated at 314. In the neutral position 312, the compressed air supplied through conduit 218 is not connected to port 316 thereof and, in fact, port 316 is connected to the exhaust port 318 to allow any compressed air in the conduit 320 to be exhausted. A spring 322 is provided to normally hold the valve 244 in the neutral position 312.

When the valve 244 is manually depressed by the operator and moves to the unclamping position 314, the port 246 is connected to the port 316 and allows the compressed air flowing through conduit 218 to flow into conduit 320. The exhaust port 318 is blocked.

Since valve 310 operates in a similar manner, by depressing both valves 244 and 310 to their unclamping positions 314, compressed air is supplied to the valve 222 through conduit 324 and compressed air flowing through conduit 326 moves the valve spools 250 of the valve 240 to its neutral position. Thus, compressed air is no longer supplied through conduit 248 to the valve 222 and the valve 222 is allowed to return to its neutral position. The compressed air flowing through conduit 324 activates the valve 222 so that valve 222 is moved to the unclamping position 276.

When the valve 222 is in the unclamping position 276, compressed air is supplied to the motor 224 so that the piston 292 is moved towards port 286. Consequently, the arms 14 and 16 are moved apart and the mold is released therefrom. When in the unclamping position 276, the valve 222 inter-connects port 226 to port 238 which supplies compressed air to port 296 of the motor 224 through conduit 298. The check valve 302 allows the free flow of compressed air into the motor 224. Air is exhausted from the motor 224 through port 286. The exhausting air flows through the throttling or flow control valve 284 which controls the rate of flow of air therethrough so that the arms 14 and 16 are moved apart at a uniform rate of speed. The exhausting air continues to flow through conduit 280 to port 236. In the unclamping position 276 valve 222 inter-connects port 236 with exhaust port 232 and the exhausting air is allowed to escape into the atmosphere.

When the mold gripping arms 14 and 16 are far enough apart, either one of the unclamping valves 244 or 310 are released and that valve will move into a neutral position 312 as a result of the force of spring 322. Consequently, the valve 222 moves to the neutral position 272 as a result of springs 228 and 230 since compressed air is no longer supplied through conduit 324 to overcome the force of springs 228 and 230. The mold gripping arms 14 and 16 remain stationary when valve 222 is in the neutral position 272.

It should be understood that the gripping arms 14 and 16 can be "jogged" to an open position by intermittently depressing both of the unclamping valves 244 and 310 and the valve 222 will move from a neutral position 272 to the unclamping position 276.

Having described the illustrated embodiment, I wish to state that it is not my intention to be limited thereto, but to be limited rather only by the scope of the appended claims.

What is claimed is:

1. A method of handling mold parts and closing a no-bake flaskless mold having converging sides comprising the combination of procedural steps of:

providing a structure having opposing arms mounted for selective movement toward and away from each other;

providing pads which rotate and self-align in approximate opposing face to face relation adjacent the end of each of said opposing arms;

moving and maintaining said opposing arms in a direction toward each other to engage one of said pads with each of two opposite converging mold part sides;

lifting said structure and rolling over said mold part 180 degrees;

continuing to grip said mold part with said pads while lowering said mold part onto a mating mold part in register therewith; and, moving said arms away from each other thereby leaving a completed closed mold.

2. The method of claim 1 in which the structure and the mold part moved are suspended and have a plane in which their combined center of gravity lies, and the steps of moving said arms are performed such that said arms are always equidistant from said plane.

* * * * *